United States Patent [19]

Ihara et al.

[11] Patent Number: 4,840,381

[45] Date of Patent: Jun. 20, 1989

[54] GOLF BALL

[75] Inventors: Keisuke Ihara, Tokyo; Yasuhide Alaki, Saitama; Jun Nomura, Yokohama, all of Japan

[73] Assignee: Bridgestone Corporation, Tokyo, Japan

[21] Appl. No.: 204,899

[22] Filed: Jun. 10, 1988

Related U.S. Application Data

[63] Continuation-in-part of Ser. No. 28,590, Mar. 20, 1987, abandoned.

[30] Foreign Application Priority Data

Mar. 20, 1986 [JP] Japan ..... 61-63668

[51] Int. Cl.[4] ..... A63B 37/14

[52] U.S. Cl. ..... 273/232; 273/218; 273/235 R; 273/227

[58] Field of Search ..... 273/232, 227, 220, 218, 273/235 R, 214, 215, 216, 222-226, 228, 229, 221

[56] References Cited

U.S. PATENT DOCUMENTS 4,090,716 5/1978 Martin et al. ..... 273/232

4,681,323 7/1987 Alaki et al. ..... 273/232

*Primary Examiner*—George J. Marlo

*Attorney, Agent, or Firm*—Birch, Stewart, Kolasch & Birch

[57] ABSTRACT

A golf ball having a plurality of recessed dimples in the surface thereof, wherein at least 90% in number of the dimples have a value of Vo in the range defined by the following equation:

$$0.35 \leqq Vo \leqq 0.47$$

wherein Vo is the volume of each dimple confined below a plane defined by the dimple edge divided by the volume of a cylinder whose bottom is defined by said plane and whose height is defined by the maximum dimple depth from the bottom: and the total volume ration Vr of the dimples is defined by the following equation:

$$Vr = Vs / (4\pi R^3/3) \times 100$$

wherein Vs is the sum of the dimple volumes as defined above, and R is the radius of the ball in the range defined by the following equation:

$$V_{RL} - N/1500 \leqq Vr \leqq V_{RU} - N/1500$$

wherein $V_{RL}$ and $V_{RU}$ are defined below, and N is the number of the dimples and ranges from 400 to 600 both inclusive;

Large sized two-piece ball: $V_{RL} = 1.14$, $V_{RU} = 1.22$, and

Large sized thread-wound ball: $V_{RL} = 1.18$, $V_{RU} = 1.26$.

4 Claims, 5 Drawing Sheets

FIG. 5
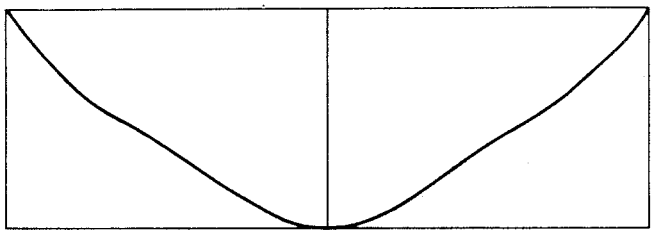
FIG. 6
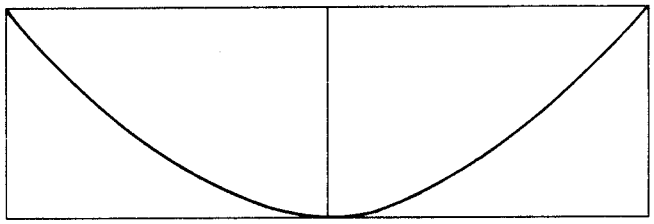
FIG. 7 *(PRIOR ART)*
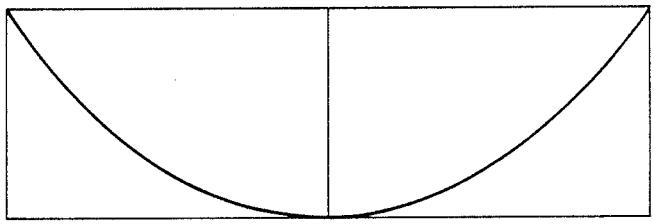
FIG. 8 *(PRIOR ART)*
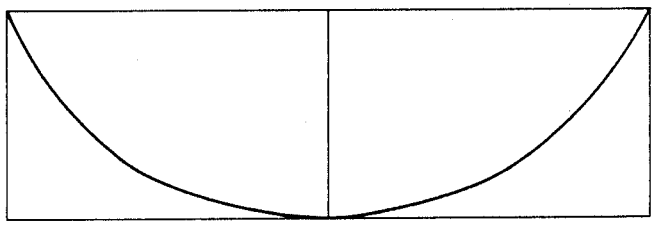

GOLF BALL

This invention is a continuation-in-part of the copending application Ser. No. 028,590 filed on Mar. 20, 1987, now abandoned.

BACKGROUND OF THE INVENTION

This invention relates to a golf ball having a large total flying distance. Total flying distance is defined as being the total distance of the carry and run of the golf ball.

Efforts have been made to increase the total flying distance of a gold ball by optimizing the arrangement, number and size (diameter and depth) of the dimples on the golf ball.

Conventional golf balls have dimples of a cross-sectional shape which sharply intrude into the ball's surface. The air resistance of the flying ball is aerodynamically greater as compared with the dynamic lift. Then, the ball cannot make effective use of the initial momentum imparted thereto, resulting in a rather short total flying distance. Most conventional dimple profiles fail to fully utilize the aerodynamic characteristics of the dimples.

Based on the discovery that not only the arrangement, number and size of the dimples on a golf ball, but also their profile and spacial volume are also significant factors which influence the ball total flying distance. There has been proposed a golf ball in which the dimples have an appropriate sectional shape to enable a large total flying distance, as disclosed in Japanese Patent Application Kokai No. 60-163674 or U.S. Patent Application Ser. No. 699,438.

In golf balls having dimples as many as 400 or more, or dimples of two or more different types, the number, shape and size of the dimples have not been fully optimized for the purpose of increasing the total flying distance. It is desired to improve the flying performance of such golf balls.

SUMMARY OF THE INVENTION

Therefore, an object of the present invention is to provide a golf ball in which the dimples are adequately configured to increase the total flying distance in accordance with the number and their size, and optionally when dimples of more than one size are formed.

We have discovered that when the cross section and the total volume of the dimples are within specific ranges, it is possible to design a golf ball having optimum dimples to increase the total flying distance irrespective of whether the ball has a large number (more than 400) of dimples or dimples of different types.

According to the present invention, there is provided a golf ball having a plurality of recessed dimples in the surface thereof, wherein at least 90% in number of the dimples have a value of Vo in the range defined by the following equation:

$$0.35 \leqq Vo \leqq 0.47 \quad (1)$$

wherein Vo is a ratio equal to the volume of each dimple confined below a plane defined by the dimple edge divided by the volume of a cylinder whose bottom is defined by said plane and whose height is defined by the maximum dimple depth from the bottom; and the total volume ratio Vr of the dimples is defined by the following equation:

$$Vr = Vs/(4\pi R^3/3) \times 100 \quad (2)$$

wherein Vs is the sum of the dimple volumes as defined above, and R is the radius of the ball in the range defined by the following equation:

$$V_{RL} - N/1500 \leqq Vr \leqq V_{RU} - N/1500 \quad (3)$$

wherein $V_{RL}$ and $V_{RU}$ are defined below, and N is the number of the dimples and ranges from 400 to 600 both inclusive;

Large sized two-piece ball: $V_{RL}=1.14$, $V_{RU}=1.22$, and

Large sized thread-wound ball: $V_{RL}=1.18$, $V_{RU}=1.26$.

BRIEF DESCRIPTION OF THE DRAWINGS

The present invention will become fully understood from the detailed description given hereinbelow and the accompanying drawings which are given by way of illustration only, and thus are not limitative of the present invention, and wherein:

FIGS. 5 and 6 are cross sectional views of dimples on golf balls according to different embodiments of the present invention;

FIGS. 7 and 8 are cross-sectional views of dimples on comparative golf balls;

DETAILED DESCRIPTION OF THE INVENTION

Figure 1:
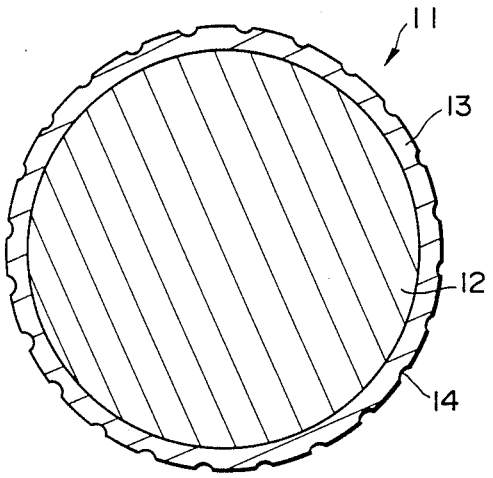
FIG. 1 is a cross sectional view of a two piece-golf ball of the present invention.
Figure 2:
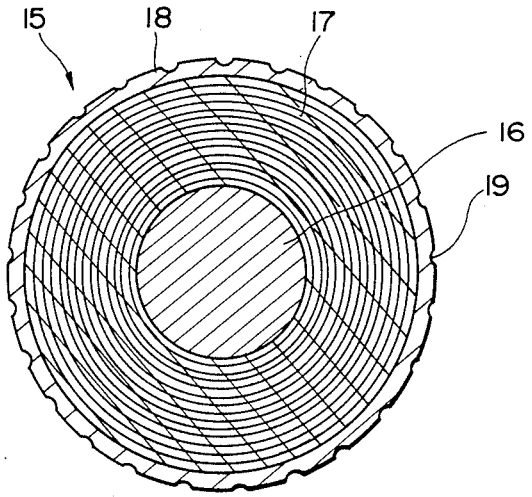
FIG. 2 is a cross sectional view of a thread-wound golf ball of the present invention.

As shown in FIGS. 1 and 2, the golf ball of the present invention includes a two-piece golf ball 11 consisting of a core 12 and a cover 13 having dimples 14, and a thread-wound ball 15 consisting of a center 16, a thread rubber 17 and a cover 18 having dimples 19.

The golf ball of the present invention is characterized by the shape of its dimples. The dimples of the golf ball of the present invention have a more gentle transition over their edge portion than prior art golf balls wherein dimple edges sharply intrude into the ball surface. In the golf ball of the present invention, at least 90% of the total number of the dimples comprise dimples having ratio Vo in the range of the following equation:

$$0.35 \leqq Vo \leqq 0.47 \quad (1)$$

wherein Vo is a ratio equal to the volume of each dimple confined below a plane which is defined by the dimple edge divided by the volume of a cylinder whose bottom is defined by said plane and whose height is defined by the maximum dimple depth from the bottom. It should be noted that ratio Vo is non-dimensional.

Figure 3:
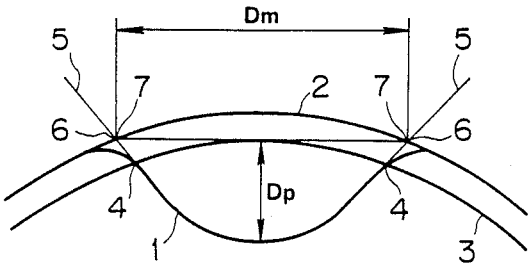
FIGS. 3 and 4 are schematic views of a dimple on a golf ball for illustrating the calculation of the spacial volume of a dimple.
Figure 4:
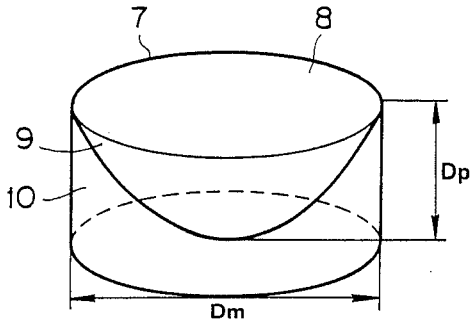

The profile of dimples on the present golf ball will be described in detail. Referring to FIGS. 3 and 4, there is illustrated a dimple 1 which is circular in plan view. Also drawn are an imaginary spherical surface 2 having a diameter equal to that of the golf ball and another imaginary spherical surface 3 having a smaller diameter by 0.16 mm than the ball diameter. The spherical surface 3 crosses the dimple 1 at intersections 4, and tangential lines 5 at intersection 4 cross the spherical surface 2 at intersections 6. Circumferential connection of the intersections 6 forms a line which represents a dimple edge 7. The dimple edge 7 is defined as described above, because the dimple edge, which is usually rounded, cannot otherwise be accurately located for volume determination.

Then, the dimple edge 7 defines and encompasses a circular plane 8 having a diameter Dm over a dimple space 9 as shown in FIG. 2. The volume Vp of the dimple space 9, which is simply referred to as "dimple volume" hereinafter, is calculated by a known method. The volume Vq of an equivalent cylinder 10 whose bottom is defined by the plane 8 and whose height is defined by the maximum dimple depth Dp from the plane 8 is then calculated by the following equation:

$$Vq=\pi Dm^2Dp/4$$

The ratio Vo of the dimple volume Vp to the cylinder volume Vq is then calculated by the following equation:

$$Vo=Vp/Vq$$

When the shape of the dimple is not circular in plan view, the dimple plane 8 is assumed to be defined by a circle having a diameter equal to the maximum diameter or length of the dimple. The ratio Vo is calculated in the same manner as described above.

The golf ball of the present invention is dimpled such that the ratio Vo thus calculated falls in the range of from 0.35 to 0.47 and preferably from 0.40 to 0.47. To increase the total flying distance of the golf ball, at least 90%, preferably at least 95%, and most preferably all of the total number of dimples must have a ratio Vo in the range of from 0.35 to 0.47, preferably 0.40 to 0.47.

Typical cross-sectional shapes of dimples on the golf balls of the present invention are illustrated in FIGS. 5 and 6. The ratio Vo is 0.43 in FIG. 5 and 0.47 in FIG. 6.

FIGS. 7 and 8 illustrate cross-sectional shapes whose ratio Vo is outside the range of the present invention. The ratio Vo is from 0.48 to 0.50 in FIG. 7 and 0.51 in FIG. 8.

In the golf ball of the present invention, the total volume ratio Vr is defined by the following equation:

$$Vr=Vs/(4\pi R^3/3)\times 100 \quad (2)$$

wherein Vs is the sum of the dimple volumes as defined above and R is the radius of the ball in the range defined by the following equation:

$$V_{RL}-N/1500 \leqq Vr \leqq V_{RU}-N/1500 \quad (3)$$

wherein $V_{RL}$ and $V_{RU}$ are defined below, and N is the number of the dimples and ranges from 400 to 600.

Large sized two-piece ball: $V_{RL}=1.14$, $V_{RU}=1.22$.

Large sized thread-wound ball: $V_{RL}=1.18$, $V_{RU}=1.26$.

By specifically limiting the total volume ratio Vr as well as the volume ratio Vo, the total flying distance of the golf ball is significantly increased because the dimple shape is optimized for 400 to 600 of total number N of the dimples.

In the above-mentioned equation (2), the sum Vs of the dimple volumes may be represented by the following equation:

$$Vs = N_1Vp_1 + N_2Vp_2 + \ldots + N_nVp_n = \sum_{i=1}^{n} NiVpi \quad (4)$$

wherein $Vp_1, Vp_2, \ldots, Vp_n$ represent the volumes of dimples with different sizes, respectively, and $N_1, N_2, \ldots, N_n$ represent the numbers of the dimples having the dimple volume $Vp_1, Vp_2, \ldots, Vp_n$, respectively.

According to the present invention, the values of the ratios Vo and Vr are limited to the above-described ranges, but the dimple shape in plan view is not limited to a particular shape. The preferred dimple shape is circular, although dimples can also be polygonal, or take on other shapes in plan view. The maximum diameter of dimples is preferably 2 to 4 mm and the maximum depth is 0.1 to 0.4 mm.

The golf ball of the present invention has 400 to 600 dimples formed in the surface of the cover. The arrangement of the dimples may be any conventional pattern, although preferred arrangements are regular icosahedral, regular dodecahedral, and regular octahedral arrangements. The dimples may preferably be distributed uniformly on the ball surface according to any of the above-mentioned arrangements.

The dimple design defined by the present invention may be applied to any type of golf ball including large balls having a diameter of at least 42.67 mm and a weight of up to 45.92 g, with the benefit of an increased total flying distance. The dimple design of the present invention may also be applied to golf balls having various structures including two-piece balls and thread-wound balls. The golf balls may have a known composition and be prepared by a known method. In particular, the present dimple design can most effectively increase the total flying distance golf ball having a cover comprising an ionomeric resin having a Shore D hardness of at least 60 or more, preferably 65 to 73.

In the golf ball according to the present invention, since both the dimple/cylinder volume ratio Vo and the total dimple ratio Vr of dimples are limited to the above-specified ranges, the dimple design may be optimized in accordance with the total number N and the types and respective numbers of the dimples, thereby improving the aerodynamic properties of the golf ball.

The following examples are comparative examples illustrate the invention without limitation.

EXAMPLES AND COMPARATIVE EXAMPLES

Large sized two-piece golf balls are thread-wound golf balls having dimples with features indicated in Tables 1 and 2 were produced as described below. These golf balls were subjected to a hitting test using a hitting robot produced by True Temper Company to evaluate the total flying distance of the balls. The golf balls had uniformly distributed dimples.

| Two-piece ball | Parts by weight |
|---|---|
| Core | |
| Cis-1,4-polybutadiene rubber | 100 |
| Zinc dimethacrylate | 30 |
| Filler | adequate amount |
| Peroxide | adequate amount |
| Cover | |
| Ionomer resin (Surlyn ®1707, Dupont of U.S.A., Shore D hardness 68) | 100 |
| Titanium dioxide | 1 |
| Thickness: 2.3 mm | |

The core composition was vulcanized in a mold at 150° C. for 25 minutes to produce a solid core. The solid core was then sheathed with the cover composition and press molded in a mold at 130° C. for 3 minutes to produce a large sized two-piece golf ball with a diameter of 42.7 mm, a weight of 45.2 g and a hardness of 100, the hardness being according to the PGA (Professional Golfers' Association) standard.

| Thread-wound ball | Parts by weight |
|---|---|
| Center | |
| Cis-1,4-polybutadiene rubber | 100 |
| Sulfur | 5 |
| Zinc oxide | 10 |
| Barium sulfate | 68 |
| Vulcanization accelerator | 1 |
| Accelerator aid | 3 |
| Thread rubber | |
| Cis-1,4-polybutadiene rubber | 50 |
| Natural rubber | 50 |
| Sulfur | 1 |
| Zinc oxide | 0.6 |
| Vulcanization accelerator | 1.5 |
| Accelerator aid | 1 |

-continued

| Thread-wound ball | Parts by weight |
|---|---|
| Cover | |
| Ionomer resin (Surlyn ®1557, DuPont of U.S.A., Shore D hardness 63) | 100 |
| Titanium dioxide | 1 |
| Thickness: 2.0 mm | |

The center composition was vulcanized at 150° C. for 20 minutes and the thread rubber composition was vulcanized at 150° C. for 40 minutes. The center was then wound with the thread rubber, sheathed with the cover composition, and press molded at 150° C. for 5 minutes to produce a large sized ionomer-covered thread-wound ball having a diameter of 42.7 mm, a weight of 45.2 g and a hardness (PGA) of 90.

Figure 9:
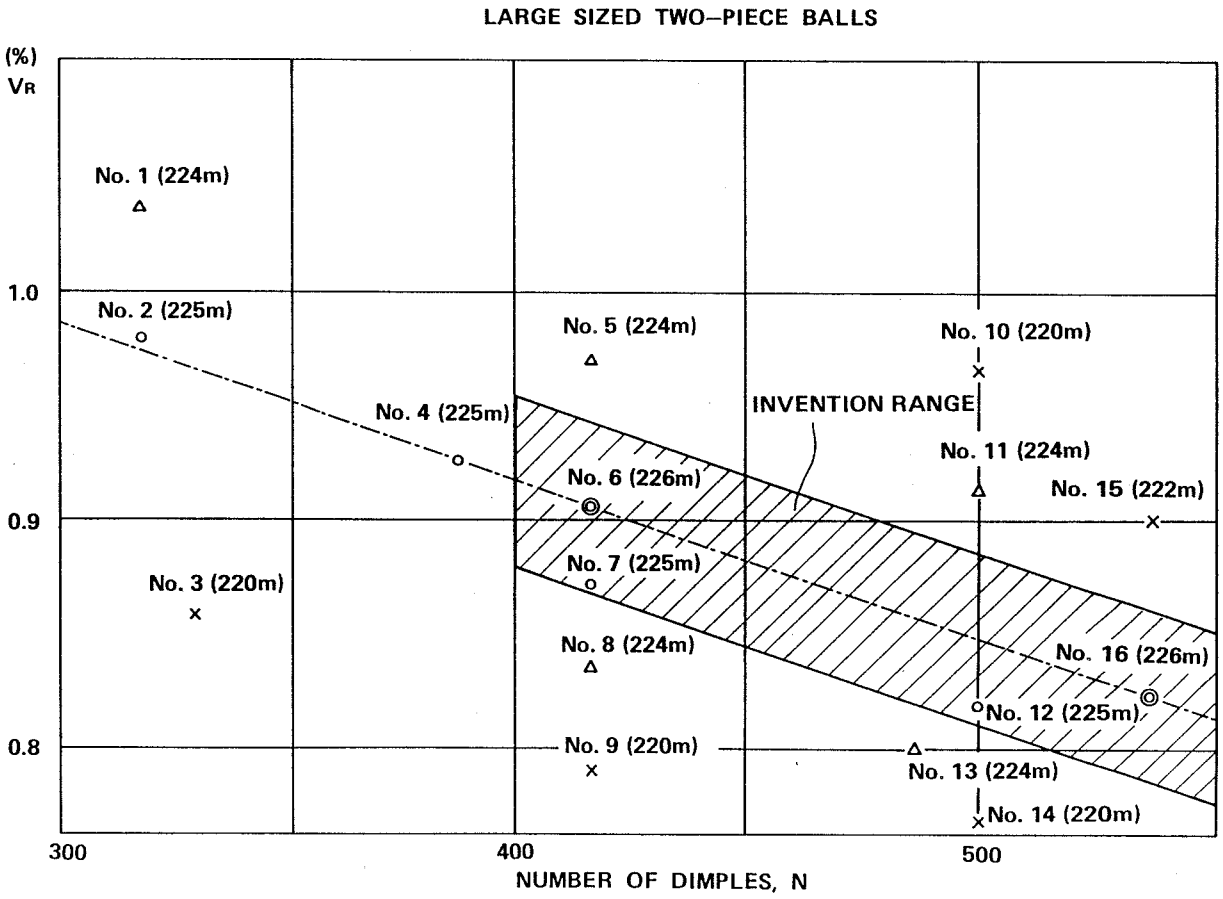
FIG. 9 is a graph illustrating the total distance in relation to the total number N and total volume ratio Vr of dimples in hitting of large sized two-piece balls having a varying number of dimples of same of different shapes.

The results obtained with the large sized two-piece balls are reported in Table 1 and FIG. 9. The results obtained with the large sized thread-wound balls are reported in Table 2 and FIG. 10.

Figure 10:
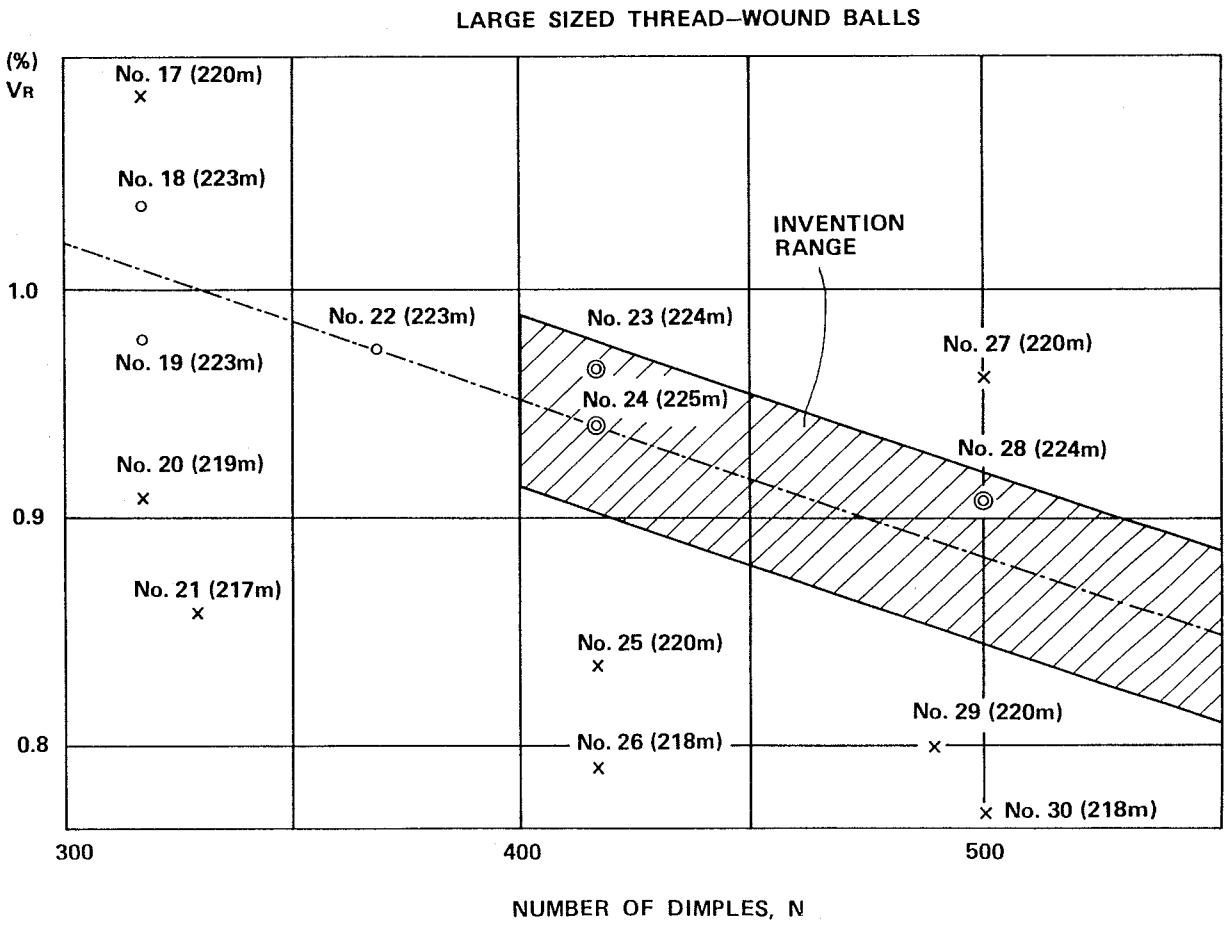
FIG. 10 is a graph illustrating the total distance in relation to the total number N and total volume ratio Vr of dimples in hitting of large sized thread-wound balls having a varying number of dimples of same or different shapes.

In FIGS. 9 and 10, the golf balls having the encircled numeral are the invention golf balls.

The hitting test was carried out by hitting the golf ball at a head speed of 45 m/sec. The total flying distance of the ball which is determined as an average of 20 hits is evaluated by the following criterion.

| Large sized ball | |
|---|---|
| Two-piece ball | Thread-wound ball |
| O longer than 225 m | O longer than 223 m |
| Δ 223–225 m | Δ 221–223 m |
| X shorter than 223 m | X shorter than 221 m |

As apparent from the results of Tables 1 and 2 and FIGS. 9 and 10, the golf balls of the invention have a long total flying distance.

TABLE 1

| Large Sized Two-Piece Balls | | | | | | | | | | | |
|---|---|---|---|---|---|---|---|---|---|---|---|
| | Feature of dimples | | | | | | | | | | Total |
| Sample No. | Diam. mm | Depth mm | Number | Diam. mm | Depth mm | Number | Total Number N | Vr | Vo | Profile | Flying distance (m) |
| 1* | 3.75 | 0.255 | 318 | — | — | — | 318 U | 1.03 U | 0.47 S | FIG. 6 | 224 |
| 2* | 3.75 | 0.26 | 318 | — | — | — | 318 U | 0.98 S | 0.43 S | FIG. 5 | 225 |
| 3* | 3.60 | 0.22 | 332 | — | — | — | 332 U | 0.85 U | 0.47 S | FIG. 6 | 220 |
| 4* | 3.60 | 0.205 | 384 | — | — | — | 384 U | 0.92 S | 0.47 S | FIG. 5 | 225 |
| 5* | 3.30 | 0.25 | 120 | 3.35 | 0.25 | 300 | 420 S | 0.96 U | 0.43 S | FIG. 5 | 224 |
| 6 | 3.30 | 0.230 | 120 | 3.35 | 0.230 | 300 | 420 S | 0.92 S | 0.44 S | FIG. 5 | 226 |
| 7 | 3.30 | 0.225 | 120 | 3.35 | 0.225 | 300 | 420 S | 0.87 S | 0.43 S | FIG. 5 | 225 |
| 8* | 3.30 | 0.22 | 120 | 3.35 | 0.22 | 300 | 420 S | 0.84 U | 0.43 S | FIG. 5 | 224 |
| 9* | 3.30 | 0.205 | 120 | 3.35 | 0.205 | 300 | 420 S | 0.79 U | 0.43 S | FIG. 5 | 220 |
| 10* | 3.20 | 0.255 | 360 | 2.45 | 0.255 | 140 | 500 S | 0.96 U | 0.43 S | FIG. 5 | 220 |
| 11* | 3.20 | 0.24 | 360 | 2.45 | 0.24 | 140 | 500 S | 0.91 U | 0.43 S | FIG. 5 | 224 |
| 12 | 3.20 | 0.220 | 360 | 2.45 | 0.22 | 140 | 500 S | 0.82 S | 0.43 S | FIG. 5 | 225 |
| 13* | 3.20 | 0.19 | 492 | — | — | — | 492 S | 0.80 U | 0.43 S | FIG. 5 | 224 |
| 14* | 3.20 | 0.205 | 360 | 2.45 | 0.205 | 140 | 500 S | 0.77 U | 0.43 S | FIG. 5 | 220 |
| 15* | 3.20 | 0.225 | 360 | 2.00 | 0.225 | 180 | 540 S | 0.90 U | 0.47 S | FIG. 6 | 222 |
| 16 | 3.20 | 0.20 | 360 | 2.00 | 0.20 | 180 | 540 S | 0.82 S | 0.47 S | FIG. 6 | 226 |

*Comparative Example
"S" denotes that N, Vr or Vo is within the range of the present invention.
"U" denotes that N, Vr or Vo is outside the range of the present invention.

TABLE 2

| Large Sized Thread-Wound Balls | | | | | | | | | | | |
|---|---|---|---|---|---|---|---|---|---|---|---|
| | Feature of dimples | | | | | | | | | | Total |
| Sample No. | Diam. mm | Depth mm | Number | Diam. mm | Depth mm | Number | Total Number N | Vr | Vo | Profile | Flying distance (m) |
| 17* | 3.75 | 0.25 | 318 | — | — | — | 318 U | 1.08 U | 0.50 U | FIG. 7 | 220 |

TABLE 2-continued

| | Large Sized Thread-Wound Balls | | | | | | | | | | |
|---|---|---|---|---|---|---|---|---|---|---|---|
| | Feature of dimples | | | | | | | | | | Total |
| Sample No. | Diam. mm | Depth mm | Number | Diam. mm | Depth mm | Number | Total Number N | Vr | Vo | Profile | Flying distance (m) |
| 18* | 3.75 | 0.255 | 318 | — | — | — | 318 U | 1.03 S | 0.47 S | FIG. 6 | 223 |
| 19* | 3.75 | 0.26 | 318 | — | — | — | 318 U | 0.98 S | 0.43 S | FIG. 5 | 223 |
| 20* | 3.75 | 0.21 | 318 | — | — | — | 318 U | 0.91 U | 0.50 U | FIG. 7 | 219 |
| 21* | 3.60 | 0.22 | 332 | — | — | — | 332 U | 0.85 U | 0.47 S | FIG. 6 | 217 |
| 22* | 3.50 | 0.235 | 240 | 3.80 | 0.235 | 132 | 372 U | 0.97 S | 0.44 S | FIG. 5 | 223 |
| 23 | 3.30 | 0.25 | 120 | 3.35 | 0.25 | 300 | 420 S | 0.96 S | 0.43 S | FIG. 5 | 224 |
| 24 | 3.30 | 0.235 | 120 | 3.35 | 0.235 | 300 | 420 S | 0.94 S | 0.44 S | FIG. 5 | 225 |
| 25* | 3.30 | 0.22 | 120 | 3.35 | 0.22 | 300 | 420 S | 0.84 U | 0.43 S | FIG. 5 | 220 |
| 26* | 3.30 | 0.205 | 120 | 3.35 | 0.205 | 300 | 420 S | 0.79 U | 0.43 S | FIG. 5 | 218 |
| 27* | 3.20 | 0.255 | 360 | 2.45 | 0.255 | 140 | 500 S | 0.96 U | 0.43 S | FIG. 5 | 220 |
| 28 | 3.20 | 0.24 | 360 | 2.45 | 0.24 | 140 | 500 S | 0.91 S | 0.43 S | FIG. 5 | 224 |
| 29* | 3.20 | 0.19 | 492 | — | — | — | 492 S | 0.80 U | 0.43 S | FIG. 5 | 220 |
| 30* | 3.20 | 0.205 | 360 | 2.45 | 0.205 | 140 | 500 S | 0.77 U | 0.43 S | FIG. 5 | 218 |

*Comparative Example
"S" denotes that N, Vr or Vo is within the range of the present invention.
"U" denotes that N, Vr or Vo is outside the range of the present invention.

What is claimed is:

1. A golf ball having a plurality of recessed dimples on the surface thereof, wherein the golf ball is a large sized two-piece ball consisting of a core and a cover; the maximum diameter of the dimples is 2 to 4 mm; the maximum depth of the dimples is 0.1 to 0.4 mm; the number of dimples is 400 to 600; at least 90% of the dimples have a value of Vo in the range defined by the following equation:

$$0.35 \leqq Vo \leqq 0.47$$

wherein Vo is the volume of each dimple confined below a plane defined by the dimple edge divided by the volume of a cylinder whose bottom is defined by said plane and whose height is defined by the maximum dimple depth from the bottom; and the total volume ratio Vr of the dimples is defined by the following equation:

$$Vr = Vs/(4\pi R^3/3) \times 100$$

wherein Vs is the sum of the dimple volumes as defined above, and R is the radius of the ball in the range defined by the following equation:

$$V_{RL} - N/1500 \leqq Vr \leqq V_{RU} - N/1500$$

wherein $V_{RL}$ is not less than 1.14 inclusive, $V_{RU}$ is not more than 1.22 inclusive, and N is the number of the dimples and ranges from 400 to 600 both inclusive.

2. The golf ball of claim 1, wherein said cover comprises an ionomeric resin having a Shore D hardness of at least 60.

3. A golf ball having a plurality of recessed dimples on the surface thereof, wherein the golf ball is a large sized thread-wound ball consisting of a center, rubber thread and a cover; the maximum diameter of the dimples is 2 to 4 mm; the maximum depth of the dimples is 0.1 to 0.4 mm; the number of dimples is 400 to 600; at least 90% of the dimples have a value of Vo in the range defined by the following equation:

$$0.35 \leqq Vo \leqq 0.47$$

wherein Vo is the volume of each dimple confined below a plane defined by the dimple edge divided by the volume of a cylinder whose bottom is defined by said plane and whose height is defined by the maximum dimple depth from the bottom; and the total volume ratio Vr of the dimples is defined by the following equation:

$$Vr = Vs/(4\pi R^3/3) \times 100$$

wherein Vs is the sum of the dimple volumes as defined above, and R is the radius of the ball in the range defined by the following equation:

$$V_{RL} - N/1500 \leqq Vr \leqq V_{RU} - N/1500$$

wherein $V_{RL}$ is not less than 1.18 inclusive, $V_{RU}$ is not more than 1.26 inclusive, and N is the number of the dimples and ranges from 400 to 600 both inclusive.

4. The golf ball of claim 3, wherein said cover comprises an ionomeric resin having a Shore D hardness of at least 60.

* * * * *